United States Patent [19]

Smith

[11] Patent Number: 4,770,030

[45] Date of Patent: Sep. 13, 1988

[54] SOIL PENETRATION AND SAMPLING SYSTEM

[76] Inventor: James C. Smith, 854 Sharon-Copley Rd., Wadsworth, Ohio 44281

[21] Appl. No.: 106,265

[22] Filed: Oct. 9, 1987

[51] Int. Cl.[4] ..... G01N 3/00

[52] U.S. Cl. ..... 73/84; 73/864.45

[58] Field of Search ..... 73/84, 151, 865.3, 81, 73/864.45

[56] References Cited

U.S. PATENT DOCUMENTS 3,611,794 10/1971 De Geeter ..... 73/84

FOREIGN PATENT DOCUMENTS 239194 10/1926 United Kingdom ..... 73/84
1497872 1/1978 United Kingdom ..... 73/84
1028772 7/1983 U.S.S.R. ..... 73/84

OTHER PUBLICATIONS

American Society for Testing and Materials Standard D 1586-84, "Standard Method for Penetration Test and Split-Barrel Sampling of Soils", pp. 298-303.

Mobile Drilling Company, Inc., Indianapolis, Ind.; "Soil Sampling Care, Rotary Tools", Catalog 747, pp. 31 & 32.

*Primary Examiner*—Jerry W. Myracle

*Attorney, Agent, or Firm*—Renner, Kenner, Greive, Bobak, Taylor & Weber

[57] ABSTRACT

A soil penetration testing system for testing soils within a bore hole. The system including a drive-weightassembly (11) positionable with the bore hole (B). The drive-weight assembly (11) has a casing (20) containing an anvil (23), a hammer (33) movable relative to the anvil (23) and a hammer lifter (50) to move the hammer (33) a preselected distance selectively to impact against the anvil (23). A penetration member (26) is carried on the anvil (23) in such fashion to penetrate the soil. A winch line (12) and winch (13) are provided to position the drive-weight assembly (11) within the bore hole (B); and a cathead line (15) also is provided to actuate the drive-weight assembly (11) when positioned within the bore hole (B).

18 Claims, 3 Drawing Sheets

SOIL PENETRATION AND SAMPLING SYSTEM

TECHNICAL FIELD

The present invention relates generally to a soil sampler. More particularly, the present invention relates to a combined soil sampler and soil penetration tester. Specifically, the present invention relates to a system for conducting soil penetration testing and soil sampling at the bottom of a bore hole.

BACKGROUND ART

Testing of soil samples generally is necessary when contemplating the design and construction of buildings and similar structures. Specifically, the designer needs to know the type, nature and characteristics of the subsurface materials so that a suitable foundation can be constructed to support the structure.

Evaluation of soil generally involves a two step procedure. The first step, known as penetration testing, requires that a rod, or the like, be driven a predetermined depth into the tested soil. The amount of work required to drive the rod reveals the load bearing characteristics of the soil. The second step of the evaluation procedure involves extraction of a sample of the soil for off-site testing.

Generally, these two procedural steps can be accomplished simultaneously. In a process known as "drive sampling", a sampler spoon is driven into the soil at the bottom of the bore hole. Specifically, once the bore hole has been completed to the proper elevation for sampling, and has been properly cleaned of loose soil and debris, a sampler spoon—such as a split tube sampler—is screwed to an assembly of drill rods. This assembly is lowered, spoon first, down into the bore hole. A drive head or anvil is attached to the top of the drill rods which extend out of the bore hole. A drive hammer, of a preselected weight, is then dropped repeatedly through a fixed elevation, onto the drive head. The distance through which the sample spoon is driven, and the number of blows applied to the drive head (the blowcount) are recorded for further analysis to determine the physical resistance of the soil. Throughout the driving process, soil is introduced into a cavity in the sampler spoon through an opening in the bottom thereof. Upon extraction of the drill rods and sample spoon from the bore hole, the soil sample can be removed from the cavity for further analysis.

Several inherent problems exist in the current test apparatus. To begin with, it is necessary to undergo the time consuming process of connecting and disconnecting successive drill rods, each typically 5 feet or 10 feet in length, every time the sample spoon is inserted into and retrieved from the bore hole. Furthermore, each drill rod, itself, is costly and adds considerable weight to the overall assembly necessitating a relatively large winch to handle positioning of the assembly.

In addition to the cost and weight disadvantage, the accuracy of the test results of the current system is not very good. Indeed, according to the American Society for Testing and Materials Standard D 1586-84 "Standard Method for Penetration Test and Split-Barrel Sampling of Soils", variations of 100% or more in the blowcount representation of the penetration resistance of the soil have been observed when using different apparatus and drillers for adjacent test boring in the same soil formation. With care, a driller may reduce the variation in the blowcount to about 10%.

These dramatic errors can be attributed, in part, to a dirty, rusty or defective cathead—the rotating drum or windlass around which the operator wraps a rope to lift and drop the hammer by successively tightening and loosening the rope turns around the drum; old and/or oily cathead rope; and/or oversized or defective rope sheaves. Additionally, errors can be attributed to kinetic energy absorbed or disposed by long lengths of connected drill rods and/or by cracked or worn joints between successive drill rods. It is difficult to calculate the amount of kinetic energy loss and derive a common correction factor to mathematically account for this deficiency; because the length of the connected drill rods vary as the boring is advanced and condition of the rods vary from boring to boring. Operator error may further amplify the inherent errors of the system, as it is necessary for the operator to lift the hammer an estimated 30 inches successively and accurately many times throughout the average test cycle.

Despite the continual need for accurate soil testing, most soil testing systems are incapable of providing accurate and reliable blowcount penetration tests, conducted at the bottom of bore holes.

DISCLOSURE OF THE INVENTION

It is, therefore, an object of the present invention to provide an apparatus for conducting soil penetration tests at the bottom of a bore hole.

It is another object of the present invention to provide an apparatus, as above, which permits a weighted hammer to be dropped repetitively and consistently accurate throughout the soil test.

It is a further object of the present invention to provide an apparatus, as above, which eliminates error in the soil test results due to the length of the drill rod or the depth of the hole.

It is still another object of the present invention to provide an apparatus, as above, wherein operator error is greatly reduced.

These and other objects of the present invention, as well as the advantages thereof over existing and prior art forms, which will be apparent in view of the following specification, are accomplished by means hereinafter described.

In general, a soil penetration testing system for testing soils within a bore hole according to the concept of the present invention includes a drive-weight assembly positionable with the bore hole. The drive-weight assembly has a casing containing an anvil, on which is carried a penetration member; a hammer, movable relative to the anvil; and a hammer lifter, provided to move the hammer a preselected distance selectively to impact against the anvil. A winch line and winch are provided to position the drive-weight assembly within the bore hole. Similarly, a cathead line is provided to actuate the drive-weight assembly when the latter is positioned within the bore hole.

An exemplary preferred embodiment of a soil penetration testing and sampling system incorporating the concept of the present invention is shown by way of example in the accompanying drawings without attempting to show all the various forms and modifications in which the invention might be embodied, the invention being measured by the appended claims and not by the details of the specification.

EXEMPLARY EMBODIMENT FOR CARRYING OUT THE INVENTION

Figure 1:
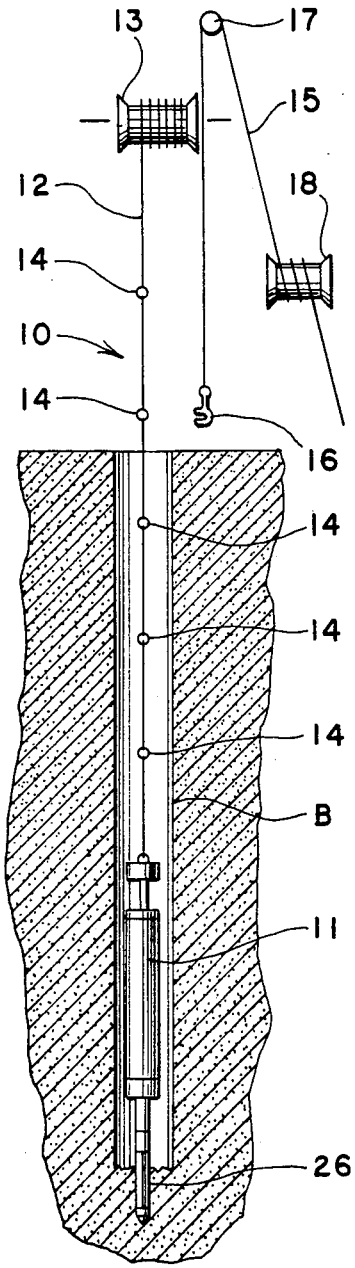
FIG. 1 is a schematic representation of a soil penetration and sampling system embodying the concept of the present invention.

A soil penetration and sampling system, according to the concept of the present invention, is indicated generally by the numeral 10 in FIG. 1. The system 10 is depicted schematically in cooperation with a bore hole B, which suitably has been prepared using known techniques.

The system 10 includes, basically, a drive-weight assembly 11 secured to a winch line 12 so as to be lowered selectively into the bore hole B using a suitable winch 13. Winch line 12 includes a plurality of eyelets 14 positioned at intervals of approximately 5 feet (1.52 meters).

A cathead line 15 is provided with a snap 16 at one end suitable to engage a selected eyelet 14. Cathead line 15 may be routed through a suitable sheave assembly 17 to a rotating cathead 18. In such fashion, as would be appreciated to one skilled in the art, cathead line 15 may be wrapped about cathead 18 to lift and drop the test hammer as will be discussed hereinafter.

Figure 2:
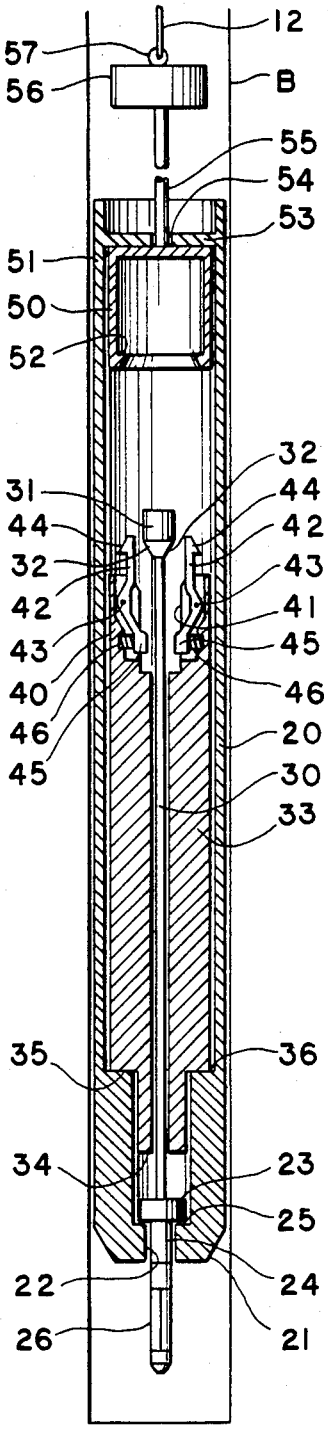
FIG. 2 through 6, inclusive, are elevational cross-sections of a soil penetration tester and sampler at various stages during a test cycle.

The structure of drive-weight assembly 11 may be more fully appreciated with reference to FIG. 2. Drive-weight assembly 11 and, thus, the components thereof, are suitably sized and configured so as to be receivable within a particular bore hole B. In this regard, drive-weight assembly 11 includes a substantially cyclindrical casing 20. The lower end of casing 20 defines a tapered shoe 21 having a centrally located axial bore 22. An anvil 23 is carried slidably within the lower end of casing 20, with a nipple 24 extending outwardly from bore 22 when anvil 23 abuts the annular interior lip 25 of shoe 21. A standard barrel sampler 26, well known in the art, is removably received onto the nipple 24, as by a threaded coupling or the like. Sampler 26 may be any type of well known soil samplers, such as a solid tube sampler or a split tube sampler. Such a sampler 26 permits an amount of soil to be retrieved from the bore hole B after sampler 26 has been driven into the soil. Of course, it should be appreciated that if soil samples are not needed or desired, sampler 26 may be replaced with a suitable solid rod for conducting only the penetration aspect of the soil test.

A rod 30 extends axially from anvil 23 opposite nipple 24. Rod 30 extends substantially concentric with casing 20. A trigger 31 is carried at the upper end of rod 30. Trigger 31 carries a substantially conical surface 32 for purposes which will be appreciated hereinafter.

A hammer 33 is slidably received about rod 30 so as to translate axially within the central region of casing 20. An annular face 34 is presented at the lowermost end of hammer 33, suitable for impacting against anvil 23 as will be appreciated hereinafter. Axially spaced from face 34 is an annular shoulder 35 configured to engage an inner ledge 36 of casing 20 to define the lower limit of travel of hammer 33.

The upper end 40 of hammer 33 includes an axial cavity 41 suitably sized to receive trigger 31 therein. A plurality of hammer latches 42 are disposed about cavity 41 and are mounted on suitable pivots 43 so as to pivot radially relative to cavity 41. Each hammer latch includes an outwardly oriented sear 44 extending axially from hammer 33. A trip lever 45 is positioned interiorly of cavity 41; and a spring 46 is suitably positioned to bias trip lever 45 radially inward, thereby biasing sear 44 radially outward.

A hammer lifter 50 is slidably received within the upper end 51 of casing 20. Hammer lifter 50 is substantially an inverted cup having an internal rim catch 52 about its lower periphery. A top 53 closes the upper end 51 of casing 20 and has a centrally located opening 54 through which link rod 55 of hammer lifter 50 slidably protrudes. A counterweight 56 is secured to the upper end of link rod 55 and provides an eyelet 57 to which winch line 12 is connected. Counterweight 56 provides sufficient downward pull on winch line 12 to overcome friction forces in the winch and cathead sheave assemblies as would be appreciated by one skilled in the art.

The soil penetration and sampling system 10, as heretofore described, may be more fully understood and appreciated by considering the operation thereof throughout an exemplary soil test procedure. For purposes of this discussion, the exemplary test procedures will be in accordance with the "Standard Method for Penetration Test and Split-Barrel Sampling of Soils", Designation D 1586-84, American Society for Testing and Materials.

Once the bore hole B has been drilled to the desired depth and loose material has been removed, leaving a relatively clean hole, the drilling apparatus is extracted from bore hole B. Winch line 12 is attached to eyelet 57 of counter weight 56; and drive-weight assembly 11, with a suitable sampler 26 attached to nipple 24, is lowered into bore hole B using winch 13.

When shoe 21 of casing 20 seats upon the bottom of bore hole B, snap 16 of cathead line 15 is attached to a nearby eyelet 14. The soil penetration and sampling system 10 is now ready for a test cycle.

Figure 3:
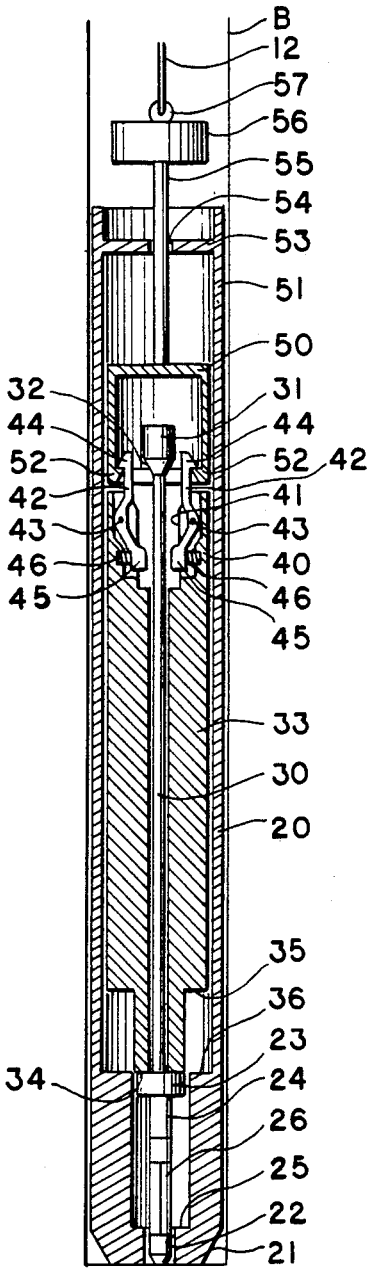

The initial position of drive-weight assembly 11, and the components thereof is depicted in FIG. 3. Shoe 21 rests upon the bottom of bore hole B as does sampler 26. Anvil 23 is urged upwardly into casing 20, contacting annular face 34 and raising hammer 33. Counterweight 56 urges hammer lifter 50 downwardly such that rim catch 52 engages sears 44 of hammer latches 42.

At this point in time, the operator pulls upwardly on winch line 12 using cathead line 15, wrapped about rotating cathead 18, in a manner known to one skilled in the art. Hammer lifter 50, engaged with hammer latches 42, thus raises hammer 33 above anvil 23.

Figure 4:
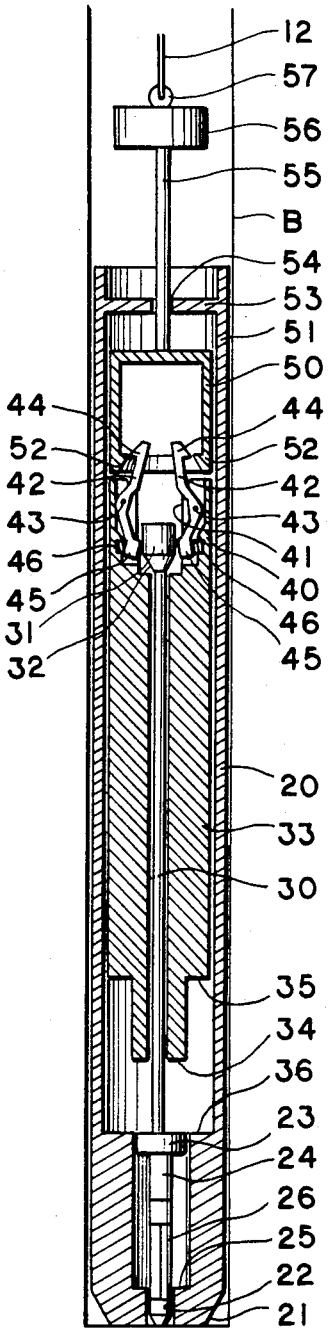

When hammer 33 is lifted a predetermined distance, for example 30 inches (76.2 cm), trip levers 45 engage conical face 32 and onto trigger 31, as depicted in FIG. 4. Trip levers 45, therefore, are urged against springs 46, pivoting sears 45 inwardly and disengaging them from rim catch 52. When this occurs, hammer 33 is permitted to fall unrestricted to impact against anvil 23, thereby driving sampler 26 into the soil at the base of bore hole B. The operator then releases the pull on cathead line 15 thereby permitting winch line 12 to be urged downwardly by counterweight 56 so that hammer lifter 50 once again engages hammer latches 42 to begin another impact sequence. Successive impacts are carried out, each time driving sampler 26 deeper into soil.

Figure 5:
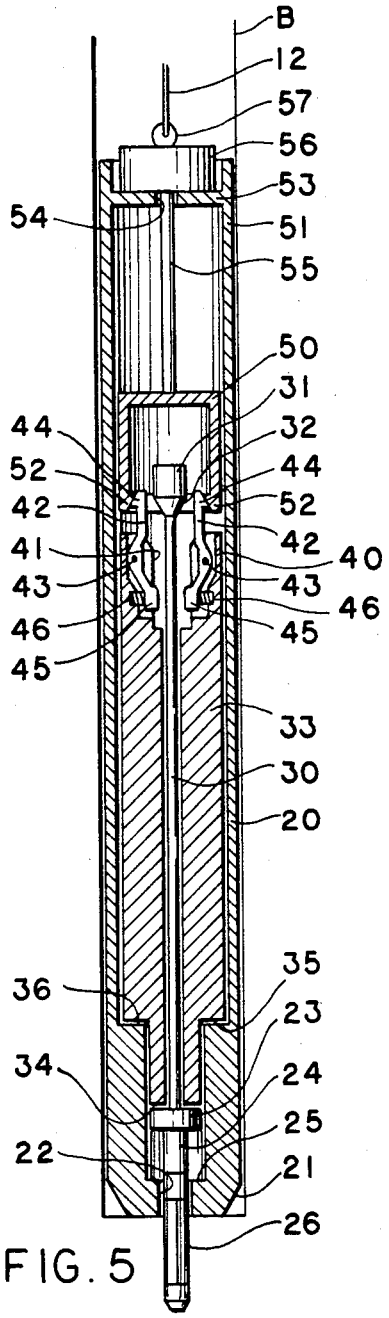

After a successive number of impacts, sampler 26 eventually will be driven sufficiently into the soil such that hammer lifter 50 will be unable to engage hammer latches 42, as depicted in FIG. 5. Specifically, the lower-most extent of movement of hammer lifter 50 is limited by counterweight 56 contacting top 53 of casing 20. As such, rim catch 52 of hammer lifter 50 is unable to engage sears 44 of hammer latches 42. This will signify that sampler 26 has been driven to the desired depth into the soil.

It should be appreciated that the depth to which sampler 26 is driven is governed by the length of link rod 55. As link rod 55 is shortened, rim catch 52 will fail to engage hammer latches 42 at a shallower depth of sampler 26.

It also should be appreciated that achievement of maximum depth by sampler 26 is readily signalled to the operator. Hammer 33 possesses significant weight, approximately 140 pounds (63.5 kg). When hammer lifter 50 can no longer engage and lift hammer 33, the operator will notice less load on cathead line 15. Such reduced load will signify maximum penetration of sampler 26; and the operator will initiate retrieval of drive-weight assembly 11 from the bore hole B.

Figure 6:
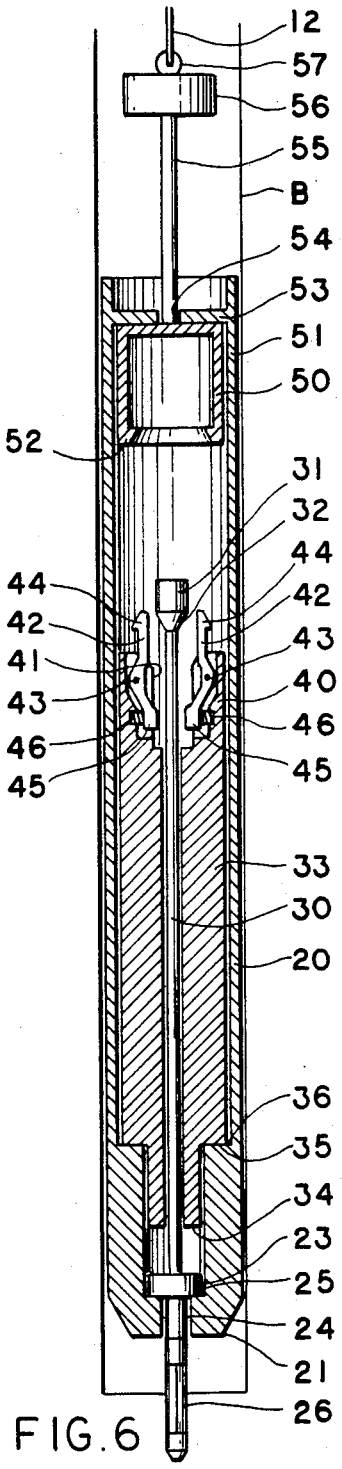

It will be appreciated that a sampler 26, driven a substantial depth—approximately 18 inches (45.72 cm)—into compact soil may be difficult to extract therefrom. Removal of sampler 26, therefore, is facilitated by drive-weight assembly 11 as depicted in FIG. 6.

Specifically, when maximum soil penetration is achieved, anvil 23 will be spaced above inner lip 25 of casing 20. As the operator retrieves cathead line 15 and winch line 12, hammer lifter 50 is raised upwards against top 53. Inner ledge 36 of casing 20 impacts annular shoulder 35 to lift the weight of hammer 33 off anvil 23. Continued retrieval raises casing 20 which causes inner lip 25 to impact against anvil 23. Successive upward blows of inner lip 25 against anvil 23 will dislodge sampler 26 from the soil. When sampler 26 is freed, cathead line 15 is disconnected from winch line 12 and drive-weight assembly 11 is retrieved from bore hole B using winch 13.

When drive-weight assembly 11 is fully extracted from bore hole B, sampler 26 is removed from nipple 24 and the soil therein is taken for subsequent analysis as is known in the art. Sampler 26 can be re-installed on nipple 24 for additional testing procedures.

In view of the foregoing, it should be appreciated that accurate testing of bore hole soil can be accomplished using the disclosed invention. A preselected weight can be dropped successively and with repeatable accuracy, from a fixed height. The resultant impact load, in addition to uniform repeatability, is transmitted directly to the sampler without losses due to friction or interconnected drill rods. Furthermore, identical test loads are achieved irrespective of the depth at which the test is conducted.

While the foregoing discussion has been directed to one exemplary embodiment of a soil penetration and sampling system, variations may be made to the disclosed embodiment without deviating from the present invention. Such variations, therefore, well known in the art, are likewise contemplated in the present invention.

It also should be evident that a soil penetration and sampling system, according to the concept of the present invention disclosed herein, carries out the various objects of the invention and otherwise constitutes an advantageous contribution to the art.

I claim:

1. An apparatus for conducting penetration testing of soils within a bore hole, comprising:

casing means positionable within the bore hole;

anvil means slidably received within said casing means;

penetration means carried by said anvil means;

hammer means slidably received within said casing means and movable relative to said anvil means; and means to move said hammer means within said casing means a preselected distance selectively to impart a driving force to said anvil means.

2. An apparatus according to claim 1 wherein said means to move comprises lifter means selectively to engage said hammer means and release means to disengage said hammer means from said lifter means at a preselected distance from said anvil means.

3. An apparatus according to claim 2 wherein said release means comprises a rod having one end affixed to said anvil means and a trigger affixed to said rod at a predetermined distance from said anvil means, said hammer means being movable relative to said rod between said anvil means and said trigger.

4. An apparatus according to claim 2 wherein said means to move further comprises latch means pivotally mounted on said hammer means and having sear means engageable with said lifter means.

5. An apparatus according to claim 4 wherein said latch means further having biasing means to urge said sear means into engagement with said lifter means.

6. An apparatus according to claim 5 wherein said release means comprises a rod having one end affixed to said anvil means and a trigger affixed to said rod at a predetermined distance from said anvil means within said casing means, said hammer means movable relative to said rod between said anvil means and said trigger.

7. An apparatus according to claim 6 wherein said latch means further having trip levers engageable with said trigger selectively to disengage said sear means from said lifter means.

8. An apparatus according to claim 7 wherein said anvil means, hammer means and lifter means are coaxially aligned within said casing means.

9. An apparatus according to claim 8 further comprising means to limit the depth of said penetration by said penetration means.

10. An apparatus according to claim 9 wherein said means to limit comprises a stop member affixed to said casing to limit movement of said lifter means.

11. An apparatus according to claim 10 further comprising eyelet means affixed to said lifter means for attachment of line means to permit positioning of said casing within the bore hole and further to permit manipulation of said lifter means.

12. An apparatus according to claim 2 wherein said means to move further comprises pivotal latch means selectively to couple said hammer means with said lifter means.

13. An apparatus according to claim 12 wherein said release means comprises trigger means at a predetermined distance from said anvil means within said casing means, said hammer means movable relative to said rod between said anvil means and said trigger means.

14. An apparatus according to claim 13 wherein said latch means further having trip levers engageable with said trigger means selectively to disengage said hammer means from said lifter means.

15. An apparatus for conducting penetration testing of soils within a bore hole, comprising:

casing means positionable within the bore hole;

anvil means slidably received within said casing means;

penetration means camed by said anvil means;

hammer means slidably received within said casing means and movable relative to said anvil means;

lifter means slidably received within said casing means;

pivotal latch means selectively to couple said hammer means with said lifter means, said latch means having trip lever means; and trigger means at a predetermined distance from said anvil means within said casing means, said hammer means movable between said anvil means and said trigger means;

said trip lever means being engageable with said trigger means selectively to disengage said hammer means from said lifter means, whereby said hammer means imparts a driving force to said anvil means.

16. A soil penetration testing system for testing soils within a bore hole, comprising:

a drive-weight assembly positionable within the bore hole, said drive-weight assembly having anvil means, hammer means movable relative to said anvil means, and lifter means to move said hammer means a preselected distance selectively to impart a driving force to said anvil means;

penetration means carried by said anvil means for penetrating the soil;

first line means secured at one end to said lifter means and the other end being operatively connected to winch means to position said drive-weight assembly within the bore hole; and means for actuating said drive-weight assembly within the bore hole.

17. A soil penetration testing system according to claim 16 wherein said means for actuating comprises second line means attachable to said first line means when said drive-weight assembly is positioned within the bore hole.

18. A soil penetration testing system according to claim 17 wherein said first line means includes a plurality of eyelet means located at spaced apart intervals therealong, said second line having a connector at one end suitable for engaging a said eyelet.

* * * * *